US009347191B2

(12) United States Patent
Kemper et al.

(10) Patent No.: US 9,347,191 B2
(45) Date of Patent: May 24, 2016

(54) STRUCTURAL TUBE BASED VEHICLE CRASH FENCE

(71) Applicant: ROSS TECHNOLOGY CORPORATION, Leola, PA (US)

(72) Inventors: Steven L. Kemper, Lancaster, PA (US); Jay P. Otto, Lititz, PA (US); Timothy J. Manzella, Macungie, PA (US)

(73) Assignee: ROSS TECHNOLOGY CORPORATION, Leola, PA (US)

( * ) Notice: Subject to any disclaimer, the term of this patent is extended or adjusted under 35 U.S.C. 154(b) by 70 days.

(21) Appl. No.: 14/331,244

(22) Filed: Jul. 15, 2014

(65) Prior Publication Data

US 2016/0017555 A1 Jan. 21, 2016

(51) Int. Cl.
*E01F 13/12* (2006.01)
*E01F 15/04* (2006.01)

(52) U.S. Cl.
CPC ..... *E01F 15/0461* (2013.01); *E01F 13/12* (2013.01); *E01F 15/0407* (2013.01)

(58) Field of Classification Search
CPC ..... E01F 13/00; E01F 15/003; E01F 15/0453; E01F 15/0461
USPC ..... 404/6, 10; 256/13.1, 65.11
See application file for complete search history.

(56) References Cited

U.S. PATENT DOCUMENTS

| | | | | |
|---|---|---|---|---|
| 917,083 | A | 4/1909 | Kyle | |
| 1,848,246 | A | 3/1932 | Dowell | |
| 3,194,537 | A | 7/1965 | Gerin | |
| 3,195,864 | A * | 7/1965 | Case | E04H 17/1413 256/65.11 |
| 3,567,184 | A * | 3/1971 | Yancey | E01F 7/06 256/13.1 |
| 4,477,059 | A * | 10/1984 | Willis | E04H 17/1413 256/59 |
| 4,542,885 | A * | 9/1985 | Rossiter | E04H 17/1413 256/55 |
| 5,664,905 | A * | 9/1997 | Thompson | E01D 19/103 248/548 |
| 6,626,406 | B1 * | 9/2003 | Olson, Jr. | H02G 7/20 248/219.2 |
| 6,637,971 | B1 | 10/2003 | Carney, III et al. | |
| 7,322,564 | B2 * | 1/2008 | Fakhari | E04H 17/1439 256/59 |
| 7,344,122 | B2 * | 3/2008 | Gasaway | E04H 17/1413 256/65.01 |
| 7,690,629 | B1 * | 4/2010 | Briggs | E04H 17/1413 256/21 |
| 7,950,870 | B1 | 5/2011 | Thompson et al. | |
| 8,444,343 | B2 | 5/2013 | McCue et al. | |
| 8,517,349 | B1 * | 8/2013 | Ross | E01F 15/143 256/1 |
| 2006/0186393 | A1 * | 8/2006 | Santelli, Jr. | E04H 17/1413 256/65.11 |

FOREIGN PATENT DOCUMENTS

| | | | |
|---|---|---|---|
| FR | 2757224 | A1 | 6/1998 |

* cited by examiner

*Primary Examiner* — Raymond W Addie
(74) *Attorney, Agent, or Firm* — Patent Law Associates; Andrew D. Mead

(57) ABSTRACT

A vehicle crash barrier constructed primarily of structural tube members having an energy-absorbing connection between horizontal rail members and vertical post members. Horizontal rail members are provided with one or more deformable flanges adjacent to each end to be connected to a vertical post member. Vertical post members include a channel adjacent a top end for receiving the rail end and flange. The rails are connected to the vertical members by downwardly sliding the flanged end into the vertical channel until the rail rests upon a bottom stop. A reinforcing cap is positioned on the top end of the vertical member to prevent upward movement of the rail and to strengthen the vertical post structure. Shims may be installed between the flange and the channel walls to limit horizontal rail movement.

17 Claims, 3 Drawing Sheets

STRUCTURAL TUBE BASED VEHICLE CRASH FENCE

BACKGROUND OF THE INVENTION

This invention relates generally to a vehicle barrier and, more particularly, to a connector arrangement for joining structural tube members in an energy dissipating configuration to create an easily installable vehicle barrier fence.

Maintaining the security of sensitive facilities from terrorist attack or unauthorized entry is of great concern. This has led to the installation of a wide array of protective barriers designs meant to prevent an unauthorized vehicle or vehicles from penetrating the secured area, and to maximize the distance between a potentially explosive laden vehicle and the facility. The need for barrier protection is not limited to gates on traditional access roads. Many facilities also require vehicle crash resistant perimeter fencing to prevent vehicle intrusion over land. Often these barriers are difficult to install to assure proper protective function of the completed barrier. More frequently, these barriers lack an aesthetically pleasing appearance and tend to call attention to the fact that the facility is being protected by a vehicle crash barrier system rather than blending into surroundings.

It would be advantageous to provide an alternative vehicle crash barrier fencing system fabricated from conventional materials that could be easily installed around a desired area to be protected from vehicular intrusion. Additional advantages would be realized by a vehicle crash barrier fencing system having an aesthetically pleasing appearance once installed to avoid highlighting the presence of a vehicle crash barrier. Still further advantages would be realized by a passive vehicle crash barrier fencing system requiring little or no maintenance once installed.

SUMMARY OF THE INVENTION

Accordingly, the present invention, in any of the embodiments described herein, may provide one or more of the following advantages:

It is an object of the present invention to provide a vehicle crash barrier fence having a connection between horizontal and vertical members capable of withstanding anticipated vehicular impact loads. Horizontal rails are provided with one or more deformable flanges adjacent to at least one end. Vertical members include a channel adjacent a top end for receiving the rail end and flange. The vertical member top end is reinforced for additional strength. Upon vehicle impact, deformation of the flange dissipates energy that would otherwise detach the connection between the horizontal rail and the vertical rail.

It is a further object of the present invention to provide an energy dissipating connection for joining a horizontal rail member to a vertical post member in a vehicle crash barrier that incorporates deformable flanges attached adjacent an end of the horizontal rail member which are engaged in a receiver in the post member. The deformable flanges are configured to deform upon a vehicle impact with the rail member prior to significant deformation of the post member and the rail member to which the flanges are attached. Deformation of the flanges dissipates energy necessary to arrest vehicle movement with limited penetration into the secured area established by the crash barrier.

It is another object of the present invention to provide a vehicle crash barrier fence having an energy-dissipating connection between horizontal and vertical members that is easily installed. Horizontal rails are provided with one or more deformable flanges adjacent to at least one end. Vertical members include a channel adjacent a top end for receiving the rail end and flange. The rails are connected to the vertical members by downwardly sliding the flanged end into the vertical channel until the rail rests upon a bottom stop. A reinforcing cap is positioned on the top end of the vertical member to prevent upward movement of the rail and strengthen the connection structure. Shims may be installed between the flange and the channel walls to limit horizontal rail movement.

It is a further object of the present invention to provide a vehicle crash barrier fence comprising structural tube members arranged to provide a simple, aesthetically pleasing design that belies the crash resistance capability of the fence. Furthermore, construction using structural tube simplifies design and installation so that crash barrier installation can be accomplished quickly and efficiently.

It is a further object of the present invention to provide a vehicle crash barrier comprising easily assembled structural tube members that is durable in construction, inexpensive of manufacture, carefree of maintenance, easily assembled, and simple and effective to use.

These and other objects are achieved in accordance with the instant invention by providing a vehicle crash barrier constructed primarily of structural tube members having an energy-absorbing connection between horizontal rail members and vertical post members. Horizontal rail members are provided with one or more deformable flanges adjacent to each end to be connected to a vertical post member. Vertical post members include a channel adjacent a top end for receiving the rail end and flange. The rails are connected to the vertical members by downwardly sliding the flanged end into the vertical channel until the rail rests upon a bottom stop. A reinforcing cap is positioned on the top end of the vertical member to prevent upward movement of the rail and to strengthen the vertical post structure. Shims may be installed between the flange and the channel walls to limit horizontal rail movement.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "upward" or "downward" are used as a matter of mere convenience, and are relative to the generally level ground or any references to "horizontal" or "vertical" planes. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
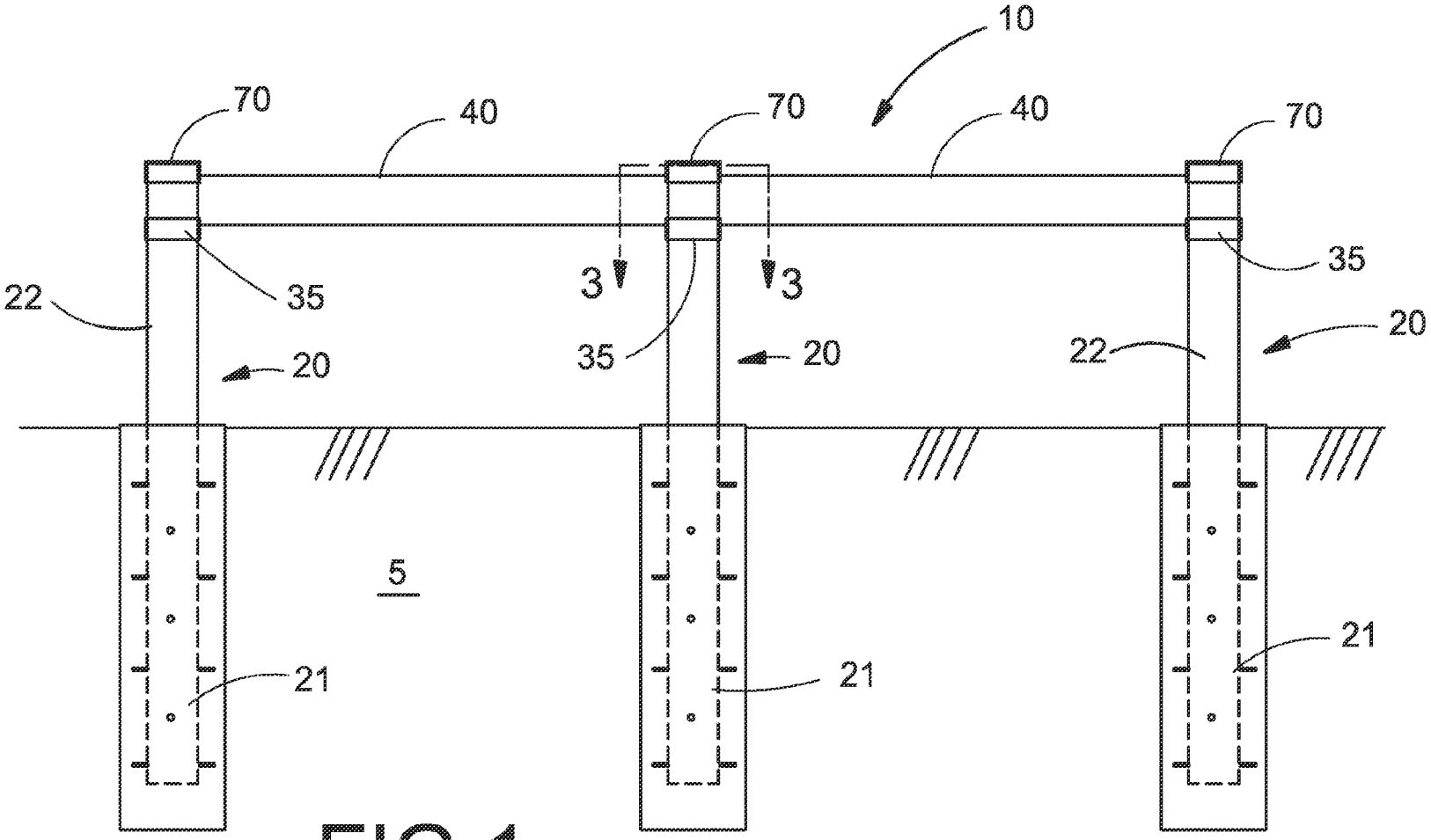
FIG. 1 in an elevation view of a vehicle crash barrier embodying aspects of the present invention.

Turning now to the drawings, FIGS. 1 through 4 illustrate aspects of an energy absorbing vehicle barrier 10 incorporating preferred embodiments of this invention. Referring to FIG. 1, the energy absorbing vehicle barrier 10 includes a plurality of spaced-apart, upstanding post members 20 partially embedded in the ground 5 and one or more generally horizontally arranged rail members 40 extending above ground between adjacent post members 20. Additional post and rail members may be added to form a vehicle crash barrier of limitless length or to close off potential vehicular entry paths approaching a structure to be protected. The vehicle barrier at issue in this application is designed to withstand at least the testing requirements delineated in ASTM F2656, "Standard Test Method for Vehicle Crash Testing of Perimeter Barriers." The concepts of the instant invention may be used to create barriers that satisfy the requirements of other crash barrier standards, both existing and as may be developed in the future.

Each post member 20 includes an embedded portion 21 that extends below grade a sufficient amount to provide the necessary anchorage for the barrier 10. Concrete is typically used to reinforce the embedded portion anchorage. The embedded portion 21 may also include outward extending anchors and the like to better engage the concrete reinforcement material and further strengthen the post anchorage in the ground. An exposed portion 22 of each post 20 extends above the ground to position the horizontal rail members 40 to a desired elevation above the ground surface.

Figure 3:
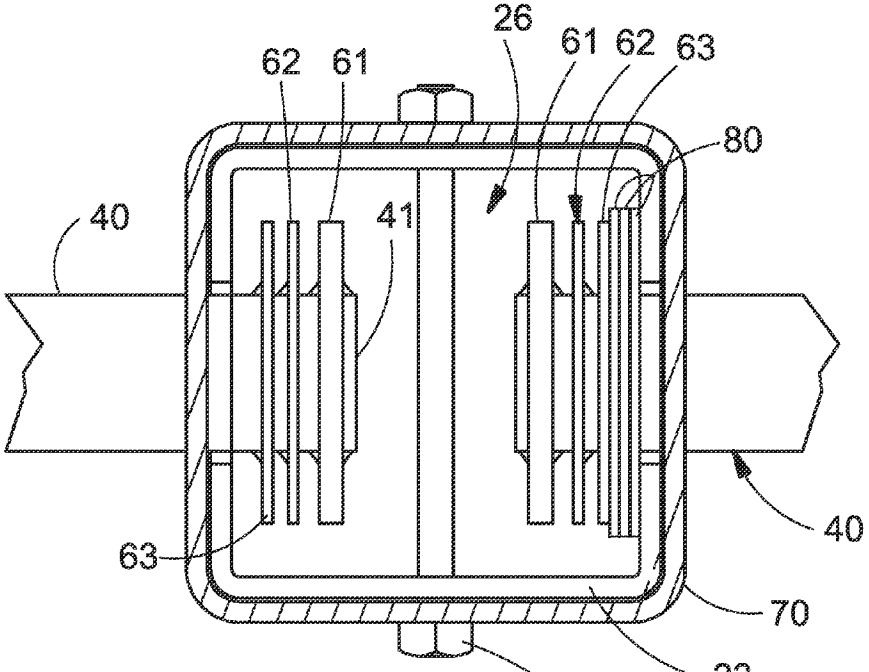
FIG. 3 is a section view of a vertical post member taken along cut line 3-3 in FIG. 1, illustrating the connection between post member and rail member.
Figure 2:
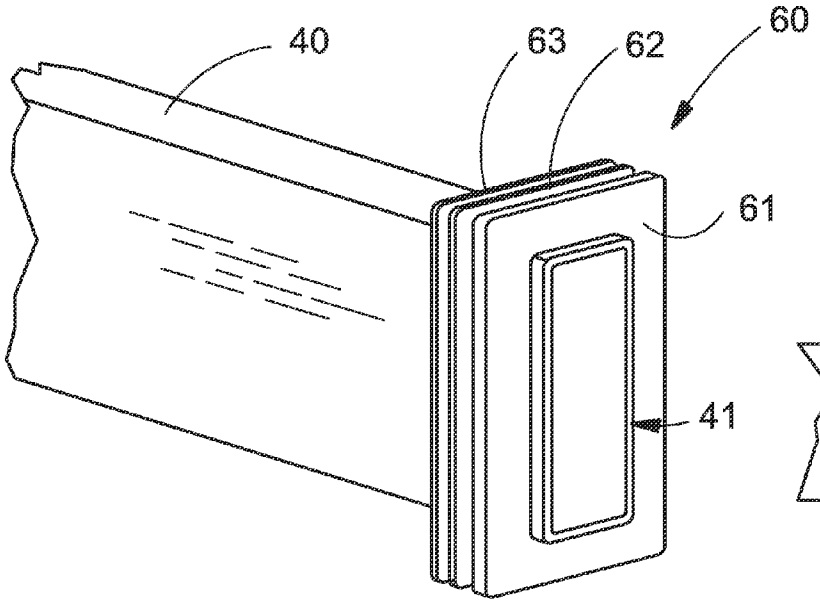
FIG. 2 is a partial perspective view of an end of a horizontal rail member showing a first embodiment of a deformable, energy-absorbing flange for use in a barrier connection.
Figure 4:
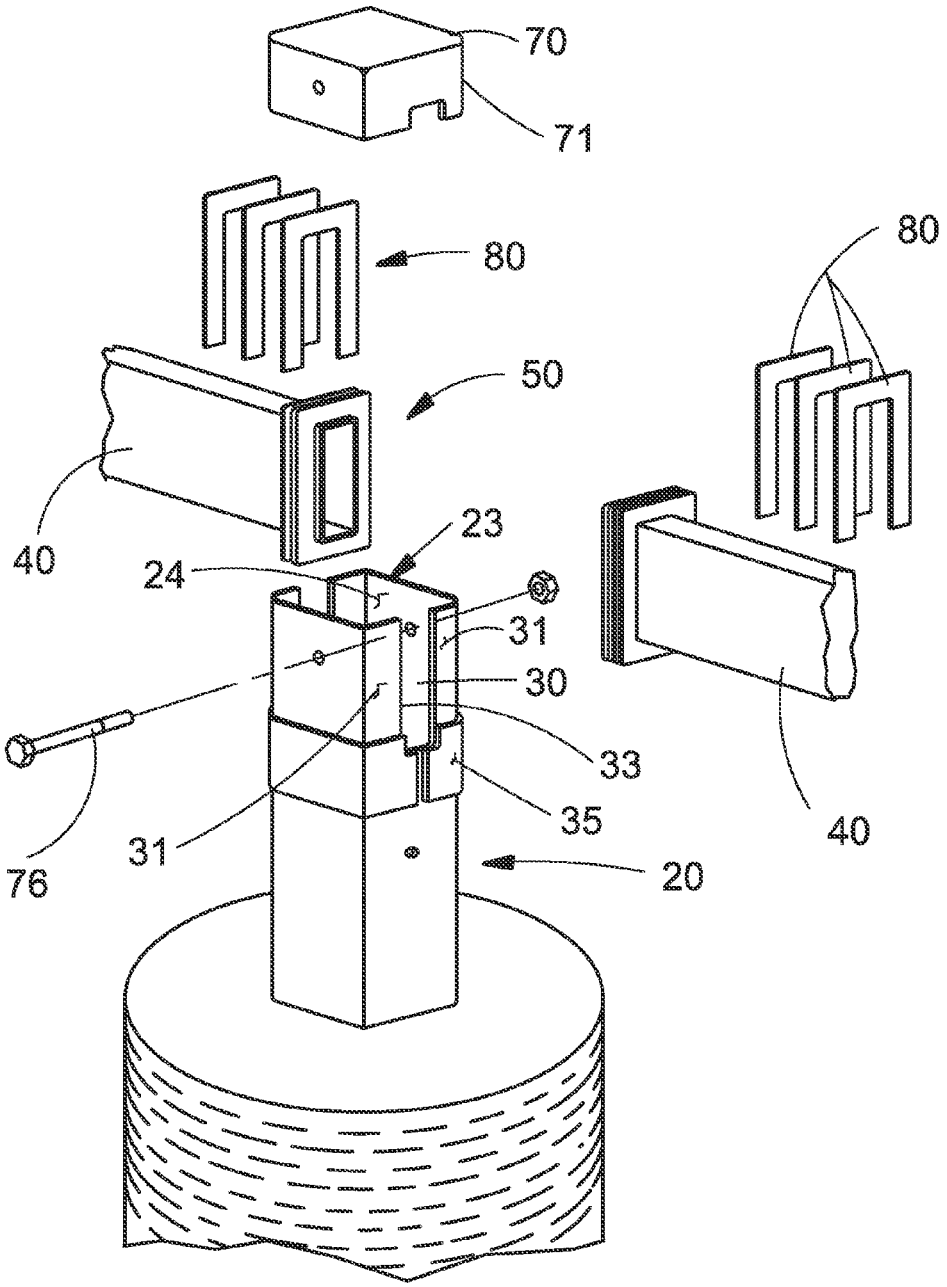
FIG. 4 is an exploded view of the post and rail connection in the vehicle crash barrier.

An exploded view of an energy absorbing connection 50 between a post member 20 and a rail member 40 is shown in FIG. 4. Viewed in conjunction with the other figures, each post member 20 is formed from a hollow structural tube having a side wall 24 surrounding an open interior cavity 26 (FIG. 3). The interior cavity 26 is open at the distal end 23 of the post 20 and at least one receiving notch 30 is provided in the side wall 24 adjacent to the distal end 23. The receiving notch 30 is sized to allow the rail member 40 to rest within and be supported by the receiving notch when the post member and rail member are perpendicularly arranged. The notch 30 does not extend the entire width of the side wall 24, but is bordered by bearing ends 31 which are the portions of the side wall on either side adjacent to the notch 30 and in the same plane as the notch. The region adjacent the lower end of the receiving notch 30 is preferably reinforced to reduce the risk of shear failure of the post side wall.

The interior cavity 26 of embedded portion 21 is preferably filled with concrete to increase post member strength. The interior cavity 26 of the exposed portion 22 positioned beneath the rail member connection 50 may also be partially concrete filled to further increase post member strength.

The rail member 40 end to be engaged in the energy absorbing connection 50 includes one or more energy dissipating flanges 60 extending outwardly from the exterior surface of the rail member. In the embodiment, a generally non-deformable stop flange 61 is connected adjacent to the end 41 of the rail member. Inwardly disposed along the rail member 40 are additional deformable flanges 62, 63 as needed to provide the energy dissipation during a vehicle impact with the rail member.

Assembly of the energy absorbing connection 50 is accomplished by first embedding a post member 20 into the ground in a generally vertical orientation with the distal end 23 upwardly oriented. A rail member 40 is positioned to rest in the receiving notch 30 so that the energy dissipating flanges 60 are disposed within the interior cavity 26 of the post member 20. The vertical edges 33 of the receiving notch are spaced apart a distance only slightly greater than the cross sectional width of the rail member, but not sufficient to allow the dissipating flanges 60 to pass through. Shims 80 may be inserted between the outer-most deformable flange 63 (in the illustrated embodiment), to minimize longitudinal movement of the rail member 40 once installed in the post member 20. A top cap 70 is provided to encircle the distal end 23 of the post. The top cap 70 includes a downwardly extending skirt 71 which is outwardly positioned in relation to the side wall 24 to strengthen the top structure of the post and limit deformation of the bearing ends 31 of the side wall as the rail members are deflected during vehicular impacts. The top cap 70 is fastened into position using a bolt 76 or the like to prevent unintentional removal or dislodgement during an impact.

While one energy absorbing connection 50 between post member and rail member is described, a vehicle barrier of significant length can be created by providing two receiving notches 30 on each post member 20 and connecting rail members in a series. The design of subsequent connections is as described above.

In a preferred embodiment, the post member and rail member are fabricated from hollow structural steel tube having a generally rectangular cross section. One such structural steel tube is manufactured in accordance with material specification ASTM A500. Wall thickness and external dimensions of the structural tube may be selected upon the desired vehicle stopping capability. The embedment depth of the post members, size of the embedded anchorage, and height of the rail member above the ground may also be varied to tailor the vehicle arresting capability of the vehicle barrier. In the exemplar embodiment, the post members are formed from 12×12×½ ASTM A500, Gr. B structural tube steel embedded 96 inches into the ground and the top end of the post extending 42 inches above the ground. The rail members are formed from 4×12×½ ASTM A500, Gr. B structural tube steel with the major axis vertically oriented with the longitudinal centerline of the rail positioned approximately 32 inches above the ground.

The deformable flanges 62, 63 and the stop flange 61 are fabricated from steel plate and welded to the structural tube. The thickness of the stop flange 61 preferably exceeds the wall thickness of the structural tube comprising the rail member 40. The relative sizing allows the relative order and magnitude of deformation of the various elements in the connection to be controlled during a vehicle impact. In the exemplar embodiment, the stop flange is fabricated from a 9×17 inch plate of 1-inch thick ASTM A-36 plate material welded to the rail. The plate extends beyond the outer periphery of the rail approximately 2⅜ inches, but allows the rail end with flanges to be inserted into the post member. The thickness of the deformable flanges 62, 63 is preferably less than the rail member wall thickness so that they will begin to deform upon vehicle impact to dissipate energy before substantial deformation the tube walls of the post member, rail member, or stop flange occurs. In the exemplar embodiment, the deformable flanges are fabricated ¼-inch thick ASTM A-36 plate material welded to the rail. The dimensions of the deformable flanges are preferably the same as the stop plate.

When assembled, the energy absorbing connection 50 positions the deformable flanges 62, 63 inwardly adjacent to the bearing ends 31 of interior side wall of the post member. Any outward longitudinal movement of the rail member 40, such as that caused by a vehicular impact, is resisted by the deformable flanges 62, 63 in contact with the inwardly facing surfaces of the bearing ends 31. Increasing tension forces in the rail member cause the outermost deformable flange 63 to deform, absorbing energy of the impact as the flange bends. As the impact load continues, the outermost flange 63 will eventually deflect until it contacts the adjacent deformable flange 62, which will then begin to deform, continuing to absorb energy of the impact. Continued deformation of the deformable flanges 62, 63 will eventually bring them into contact with the stop flange 61. The stop flange 61 is thicker than either of the deformable flanges (by a factor of four in the preferred embodiment). The stop flange 61 is also thicker than the wall thickness of the rail member 40; however, the stop flange may also be deformed dependent upon the magnitude of the vehicle impact. The number, sizing, and spacing of the deformable flanges may be varied to achieve the required energy dissipation. The stop flange prevents the rail member from disengaging from the post member unless the vehicle impact forces grossly exceed the material strength of the post and rail members.

Naturally, the invention is not limited to the foregoing embodiments, but it can also be modified in many ways without departing from the basic concepts. It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An energy dissipating joint for connecting a rail to a post in a vehicle barrier fence comprising:

a generally upstanding post having a top end and at least one side wall defining an interior cavity;

an elongate rail having generally opposing ends, at least one of the ends being supported by the post, the opposing ends defining a longitudinal axis therebetween;

at least one deformable flange attached adjacent one end of the rail, the flange extending outwardly generally orthogonally around the rail; and a receiver disposed in the at least one side wall adjacent the top end, the receiver having a pair of generally spaced apart bearing ends defining an opening through the at least one side wall through which the rail may extend, the opening sized to inhibit longitudinal movement of the rail by interaction between the bearing ends and the at least one deformable flange causing deformation thereof, the energy dissipating joint being connected by positioning the rail in the receiver and the at least one deformable flange in the interior cavity.

2. The energy dissipating joint of claim 1, further comprising a stop flange generally orthogonally around the rail and disposed adjacent to the one end of the rail between the one end and the at least one deformable flange.

3. The energy dissipating joint of claim 2, wherein the rail has at least one wall surrounding a hollow interior space, the at least one wall having a wall thickness.

4. The energy dissipating joint of claim 3, wherein the at least one deformable flange has a thickness in the longitudinal axis that is less than the wall thickness.

5. The energy dissipating joint of claim 4, wherein the stop flange has a thickness that is equal to or greater than the wall thickness.

6. The energy dissipating joint of claim 5, wherein the upstanding post further comprises a cap encircling the at least one side wall adjacent to the top end and spanning bearing ends of the receiver.

7. The energy dissipating joint of claim 6, wherein the post member and the rail member are formed from structural tube having a generally rectangular cross section.

8. The energy dissipating joint of claim 7, further comprising a shim disposed between the at least one deformable flange and the bearing ends to limit longitudinal rail movement.

9. A structural tube based vehicle crash barrier having an energy absorbing connection for joining structural tubes comprising:

a pair of spaced apart generally upstanding elongate posts each having a top end, and embedded end, and at least one side wall defining an interior cavity, the posts being partially ground embedded;

a hollow elongate rail having generally opposing ends defining a longitudinal axis therebetween, the rail generally spanning the space between the pair of posts;

at least one deformable flange attached adjacent each end of the rail, the flanges extending outwardly generally orthogonally around the rail; and a receiver disposed in the at least one side wall adjacent the top end of each post, each receiver having a pair of generally spaced apart bearing ends defining an opening in the at least one side wall through which the rail may extend, the opening sized to inhibit longitudinal movement of the rail by interaction between the bearing ends and the at least one deformable flange causing deformation thereof, the crash barrier being assembled by positioning the rail such that each end is disposed in a respective receiver and the at least one deformable flange of each end of the rail is disposed within the respective interior cavity, deformation of the flanges absorbing crash energy without disengaging from the respective receivers.

10. The crash barrier of claim 8, further comprising a stop flange generally orthogonally around the rail and disposed adjacent to each end of the rail between the end and the at least one deformable flange.

11. The crash barrier of claim 9, wherein each deformable flange has a thickness in the longitudinal axis that is less than the thickness of the at least one side wall.

12. The crash barrier of claim 10, wherein each upstanding post further comprises a cap encircling the at least one side wall adjacent to the top end and spanning bearing ends of the receiver.

13. The crash barrier of claim 10, wherein the post members and the rail member are formed from structural tube having a generally rectangular cross section.

14. The crash barrier of claim 13, further comprising a shim disposed between the at least one deformable flange and the bearing ends to limit longitudinal rail movement.

15. A method for creating a structural tube based vehicle crash barrier with an energy dissipating connection between tube members comprising the steps of:

providing a plurality of generally upstanding posts, each having a top end and at least one side wall defining an interior cavity;

providing a hollow elongate rail having generally opposing ends defining a longitudinal axis therebetween;

providing at least one deformable flange attached adjacent each end of the rail, the at least one flange extending outwardly generally orthogonally around the rail;

providing a receiver disposed in the at least one side wall adjacent the top end of each post, each receiver having a pair of generally spaced apart bearing ends defining an opening in the at least one side wall through which the rail may extend, the opening sized to inhibit longitudinal movement of the rail by interaction between the bearing ends and the at least one deformable flange, the interaction causing energy dissipation through deformation of the at least one flange;

embedding the plurality of posts in the ground in a spaced-apart array;

placing each end of the rail in respective receivers in adjacent posts in a manner such that each at least one deformable flange is received into the respective receptacle;

providing plurality of caps, one for each of the plurality of posts, each cap configured to encircle the respective at least one side wall adjacent to the top end and spanning bearing ends of the receiver; and placing one of the plurality of caps on the top end of each of the plurality of posts to retain the rail ends in the respective receivers.

16. The method of claim 15, further comprising the steps of:

providing a stop flange generally orthogonally around the rail and disposed adjacent to each end of the rail between the end and the at least one deformable flange; and engaging the stop flange and the at least one deformable flange on each rail end in the respective receivers.

17. The method of claim 16 further comprising the steps of:

providing a shim configured to be received in the receiver; and positioning the shim between the at least one deformable flange and the bearing ends to limit longitudinal rail movement.

* * * * *